US006581310B1

(12) United States Patent
Ferrier

(10) Patent No.: US 6,581,310 B1
(45) Date of Patent: Jun. 24, 2003

(54) HOLIDAY COUNTDOWN DEVICE

(76) Inventor: Carol Ferrier, 2517 Dunksferry Rd., L204, Bensalem, PA (US) 19020

( * ) Notice: Subject to any disclaimer, the term of this patent is extended or adjusted under 35 U.S.C. 154(b) by 18 days.

(21) Appl. No.: 10/081,791

(22) Filed: Feb. 22, 2002

(51) Int. Cl.[7] ..... G09D 3/00
(52) U.S. Cl. ..... 40/107; 40/617
(58) Field of Search ..... 40/617, 637, 107, 40/119, 121

(56) References Cited

U.S. PATENT DOCUMENTS 1,788,591 A * 1/1931 Regen ..... 40/617
2,440,062 A * 4/1948 Allen ..... 40/107
2,914,871 A * 12/1959 Smith et al. ..... 40/107
4,975,061 A * 12/1990 Avrill ..... 40/107
5,058,296 A * 10/1991 Notzel ..... 40/107
5,257,940 A * 11/1993 Schaarschmidt ..... 40/107
5,813,539 A * 9/1998 DePalma ..... 40/107

* cited by examiner

*Primary Examiner*—Gary Hoge

(57) ABSTRACT

A holiday countdown device used to keep track of the days preceding a holiday or special event. The device is constructed from an elongated piece of fabric, having a top portion, a bottom portion, and a middle portion. An overlay extends down the length of the piece of fabric, with a plurality of ribbons attached to the overlay in a straight column. Each ribbon has a midpoint stitched to the overlay and two unattached halves. The number of ribbons on the device constitute the number of days in the countdown. The ribbons are tied around a treat, and as each day elapses, the uppermost ribbon is untied and the treat is released.

7 Claims, 2 Drawing Sheets

HOLIDAY COUNTDOWN DEVICE

BACKGROUND OF THE INVENTION

The invention relates to a holiday countdown device. In particular, the invention is a hanging device that allows children and adults to monitor the days preceding a special event or holiday.

Holidays are very anticipated events for children, as well as adults, the most anticipated day for most being Christmas. Children are often very excited for the arrival of Christmas and continuously ask adults for a countdown till the special day. Many calendars have been devised particularly for this season. Besides counting down the days to the holiday, the calendars are also used to teach children a sense of time, as well as to count.

Thus, there exists a need for a countdown device that may aid a child in keeping track of the days until a special day, while providing a festive decoration. Such a device should provide incentives to children for marking the days, namely releasing a treat at the end of each day.

While the units available may be suitable for the particular purpose employed, or for general use, they would not be as suitable for the purposes of the present invention as disclosed hereafter.

SUMMARY OF THE INVENTION

In view of the foregoing disadvantages inherent in the prior art, the present invention provides an improved holiday countdown device. As such, the general purpose of the present invention, which will be described subsequently in greater detail, is to provide a new and improved holiday countdown device which has all the advantages of the prior art and none of the disadvantages.

To attain this, the present invention essentially comprises a holiday countdown device used to keep track of the days preceding a holiday or special event. The device is constructed from an elongated piece of fabric, having a top portion, a bottom portion, and a middle portion. An overlay extends down the length of the piece of fabric, with a plurality of ribbons attached to the overlay in a straight column. Each ribbon has a midpoint stitched to the overlay and two unattached halves. The number of ribbons on the device constitute the number of days in the countdown. The ribbons are tied around a treat, and as each day elapses, the uppermost ribbon is untied and the treat is released.

It is an object of the invention to produce a holiday countdown device that aids a child or adult in keeping track of the days preceding a special event or holiday. Accordingly, the countdown device is designed to monitor a specific number of days, while providing treats at the end of each day.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
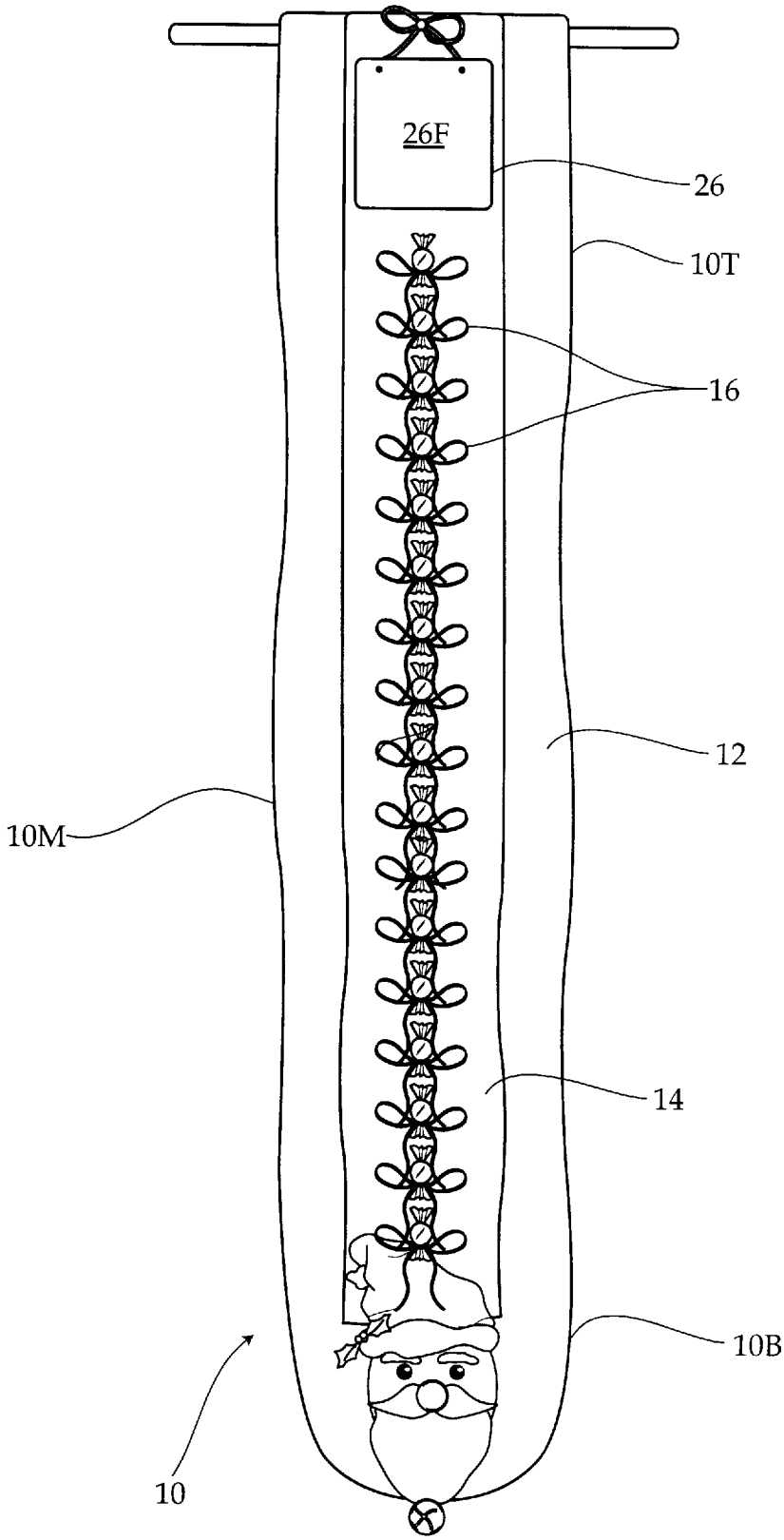
FIG. 1 is a front elevational view of the holiday countdown device.

10 holiday countdown device
10T top portion of device
10B bottom portion of device
10M middle portion of device
12 elongated piece of fabric
14 overlay
16 ribbons
16M midpoint of ribbons
16H halves of ribbons
18 hanging pole
20 bell
22 plush toy
24 treat
26 plaque
26F front surface of plaque

DETAILED DESCRIPTION OF THE PREFERRED EMBODIMENTS

FIG. 1 illustrates a holiday countdown device 10 that is used to keep track of the days preceding a holiday or special event. The device 10 is constructed from an elongated vertical piece of fabric 12, and essentially comprises a top portion 10T, a bottom portion 10B, and a middle portion 10M extending therebetweeen.

Figure 2:
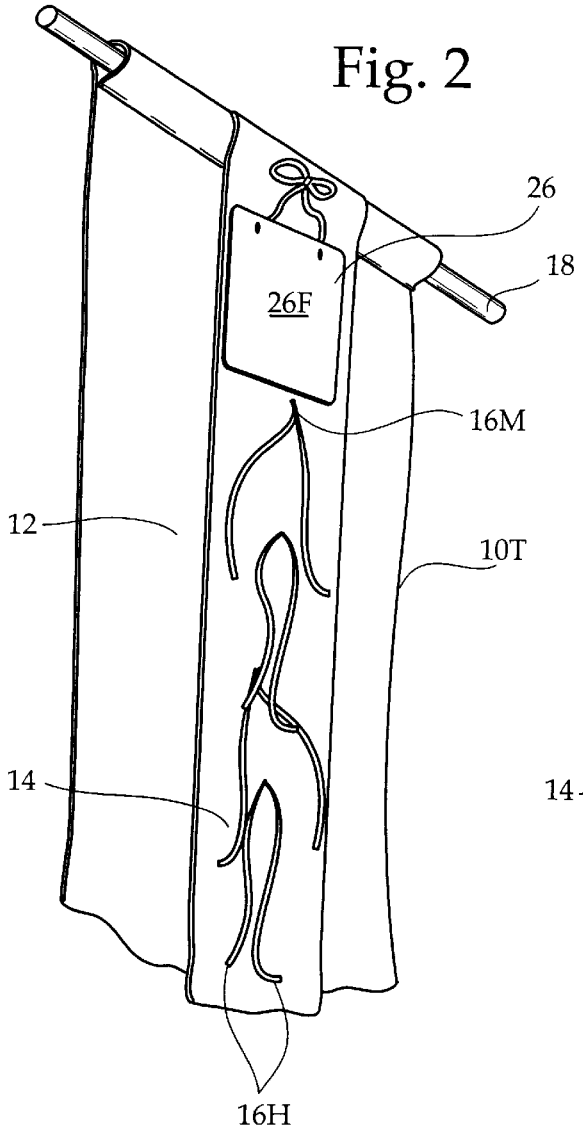
FIG. 2 is a perspective view of the top potion of the holiday countdown device.
Figure 3:
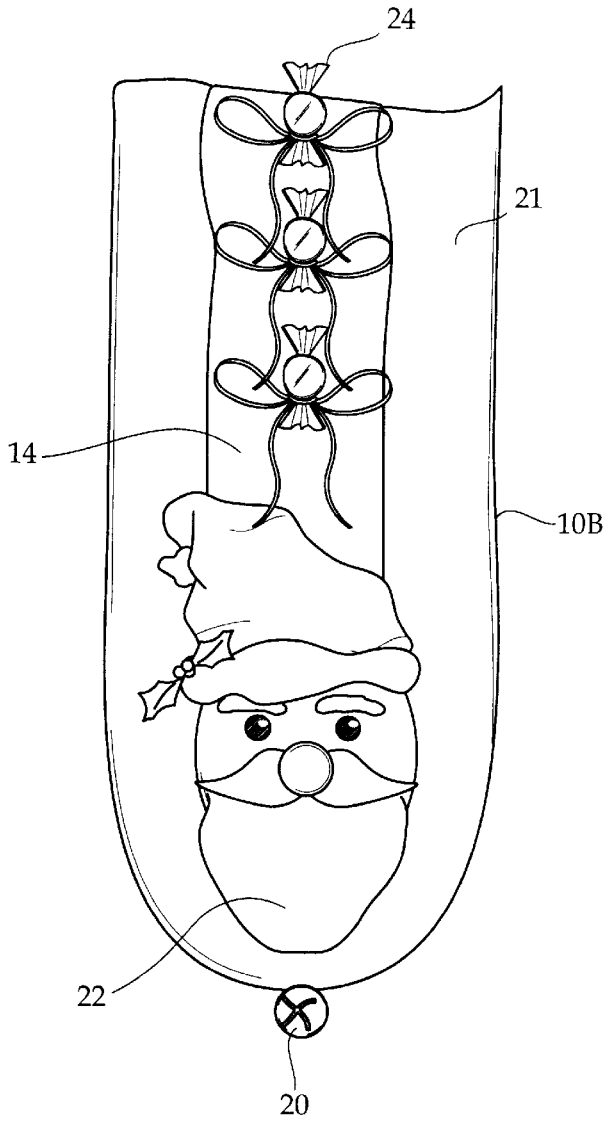
FIG. 3 is a front elevational view of the bottom portion thereof.

An overlay 14 extends down the length of the piece of fabric 12, running from the top portion 10T to the bottom portion 10B. A plurality of ribbons 16 are attached to the overlay 12 in a vertical column. As illustrated in FIG. 2, each ribbon 16 has a midpoint 16M and two halves 16H. The midpoint 16M of each ribbon 16 is stitched to the overlay 12, leaving the halves 16H unattached.

The device 10 is designed to be displayed in a hanging fashion, with the top portion 10T fastened to a wall or a hanging pole 18. At the bottom portion 10B, below the column of ribbons 16, is positioned a bell 20, along with a plush toy 22. A plaque 26 may be attached to the top portion, said plaque 26 having a front surface 26F for displaying words or pictures thereon.

While the holiday countdown device 10 may be used in the anticipation of any holiday or special event, i.e. birthdays, the device 10 is depicted in the figures as representing the Christmas season. The number of ribbons 16 constitute a countdown to Christmas. By way of example, twenty-four (24) ribbons 16 are stitched to the overlay 14, each ribbon 16 representing one day from December 1 to December 24 (Christmas Eve). The ribbons 16 are tied around a treat 24, namely a piece of candy. As each day elapses, the uppermost ribbon 16 is untied and the treat 24 is released. The untying of the last ribbon 16 signifies the end of the countdown, wherein the following day is the anticipated holiday.

In conclusion, herein is presented a holiday countdown device. The invention is illustrated by example in the drawing figures, and throughout the written description. It should be understood that numerous variations are possible, while adhering to the inventive concept. Such variations are contemplated as being a part of the present invention.

What is claimed is:

1. A holiday countdown device used to count a number of days until a holiday, comprising:

an elongated piece of fabric, the fabric having a top portion, a bottom portion, and a middle portion extending therebetween;

an overlay, the overlay positioned over the elongated piece of fabric; and a plurality of ribbons attached to the overlay, each ribbon having a midpoint and a two halves, the midpoint being stitched to the overlay and the halves left unattached, wherein the number of ribbons corresponds to the number of days being counted.

2. The holiday countdown device as recited in claim 1, wherein the ribbons are arranged in a straight column, beginning at the top portion and extending to the bottom portion of the elongated piece of fabric.

3. The holiday countdown device as recited in claim 2, wherein each of the ribbons are tied around a treat.

4. The holiday countdown device as recited in claim 3, further comprising a plush toy at the bottom portion of the elongated piece of fabric.

5. The holiday countdown device as recited in claim 4, further comprising a bell at the bottom portion of the elongated piece of fabric, below the plush toy.

6. The holiday countdown device as recited in claim 3, further comprising a plaque at the top portion of the elongated piece of fabric, the plaque having a surface for displaying words or pictures thereon.

7. A method of counting a number of days preceding a holiday using a holiday countdown device, the device comprising an elongated piece of fabric with an overlay positioned thereover, a plurality of ribbons attached to the overlay, each ribbon tied around a treat, wherein the number of ribbons corresponds to the number of days being counted, comprising the steps of:

(a) attaching ribbons to the overlay according to the number of days to be counted;

(b) tying each ribbon around one of the treats;

(c) untying one ribbon for each elapsed day, beginning with the uppermost ribbon;

(d) removing the treat from the ribbon;

(e) repeating the steps (c) and (d) until the last ribbon is untied, thus signifying the end of the countdown.

* * * * *